United States Patent [19]

Koiyumäki et al.

[11] Patent Number: 4,607,388

[45] Date of Patent: Aug. 19, 1986

[54] FLEXIBLE CONTAINER FOR TRANSPORTING AND STORING BULK GOODS

[75] Inventors: Veikko Koiyumäki; Hannu Tamminen; Pekka Peltonen, all of Pori; Veikko Koski, Luvia, all of Finland

[73] Assignee: Oy Rosenlew AB, Finland

[21] Appl. No.: 711,386

[22] Filed: Mar. 13, 1985

[30] Foreign Application Priority Data

Mar. 15, 1984 [FI] Finland ..... 841059

[51] Int. Cl.[4] ..... B65D 33/16; B65D 88/16

[52] U.S. Cl. ..... 383/121; 383/6; 383/104; 383/119; 383/120

[58] Field of Search ..... 383/6, 7, 104, 119, 383/120, 121, 124, 125

[56] References Cited

U.S. PATENT DOCUMENTS

| | | | |
|---|---|---|---|
| 815,255 | 3/1906 | Bell | 383/104 X |
| 3,319,540 | 5/1967 | Stengle, Jr. | 383/121 X |
| 3,907,241 | 7/1976 | Hanson | 383/124 |
| 4,136,723 | 1/1979 | Skaadel et al. | 383/121 X |

FOREIGN PATENT DOCUMENTS

| | | | |
|---|---|---|---|
| 26287 | 4/1981 | European Pat. Off. | 383/7 |
| 26288 | 4/1981 | European Pat. Off. | 383/7 |
| 2143819 | 4/1973 | Fed. Rep. of Germany | 383/121 |
| 61174 | 2/1982 | Finland . | |

*Primary Examiner*—William Price
*Assistant Examiner*—Sue A. Weaver
*Attorney, Agent, or Firm*—Steinberg & Raskin

[57] ABSTRACT

A flexible container for transporting and storing bulk goods, preferably arranged so as to be liftable by its upper end, is constructed from a tubular blank so as to include a shell, a bottom and a filling aperture, pleats being formed in the shell and having lower parts which are folded so as to be coplanar with the container bottom. The free, lower margin of the tubular container blank is closed by a bottom seam located substantially in the central region of the container bottom and the upper plane of each pleat is folded into the plane of the container bottom and affixed to the lower plane of the respective pleat by a connecting seam. On each side of the bottom seam, there is at least one supporting seam substantially parallel to the bottom seam. The distance of each supporting seam is advantageously in the range of about $\frac{1}{3}$ to $\frac{1}{4}$ of the half-length of the connecting seam.

3 Claims, 5 Drawing Figures

FLEXIBLE CONTAINER FOR TRANSPORTING AND STORING BULK GOODS

BACKGROUND OF THE INVENTION

This invention relates generally to flexible containers for transporting and storing goods and, more particularly, to such flexible containers which are constructed from a tubular blank formed so as to include a shell, a bottom and a filling aperture, the container being liftable by its upper end and wherein pleats are formed in the container shell having lower parts which are folded into the plane of the container bottom, the free lower margin of the tubular blank being closed by a bottom seam located substantially in the central region of the container bottom, and upper and lower planes of each pleat both folded down into the plane of the container bottom and affixed to one another by a connecting seam.

A first type of flexible transport and storage container for bulk goods is known and is disclosed in Finnish Pat. No. 61,006. A container of this type is preferably provided with an inner bag of impermeable material and substantially formed of a single piece of tight material having lifting loops in its upper portion and a filling aperture in a central portion. The bottom portion of the container includes at least four flaps provided in respective pairs of equal size flaps and which constitute linear extensions of the container shell, the flaps of each pair being joined at the lower margin so as to form juncture lines which intersect at a single point. Similar bags of this type are also disclosed in CH-Pat. No. 362,970 and in German Publicizing Print No. 1,126,795. A drawback inherent in large-size bags of this first prior art type is that the bottom of the bag cannot withstand the high stresses to which the central region of the bag bottom is subjected when the bag is filled with bulk goods. This inability to withstand high stresses is due to the fact that the juncture lines provided in the bag bottom intersect at the central point of the bag where the highest peak stresses occur. The peak stresses occur in the central region of the bag bottom as a result of the fact that when filled with bulk goods, the bottom portion of the large-size bag tends to assume a rounded shape.

A second type of prior art flexible container for transporting and storing bulk goods is disclosed in Finnish Pat. No. 57,382. In a container of this prior art type, the bottom is constructed of strip-like parts which are joined by connecting seams which are disposed to extend at a substantial distance from the central area of the bag bottom. A container bottom of this type is capable of reliably withstanding all stresses which may be imposed on the container bottom in normal practice since no connecting seams are disposed in the central region of the container bottom which would tend to reduce the strength thereof. This known design for a container bottom may be utilized equally as well as containers provided with lifting loops in their upper portion as well as in containers which are not provided with such lifting loops, such containers which are not provided with lifting loops, i.e. so-called open bags, are sealed at their filling apertures and may be lifted, for example, utilizing an appropriate lifting hook.

Containers of the second prior art type discussed above have the drawback that the relatively complex structure of the container bottom prevents the manufacture of such containers in an automated fashion or at least makes such automation exceedingly difficult and costly to accomplish. Moreover, several separate manufacturing steps are required to construct containers of this second prior art type, namely, cutting the bottom strips and the affixation of the same. Such drawbacks result in relatively high production costs.

A third type of prior art large-size bag is also known, namely, the so-called pleated large-size bag. In this construction, the pleats are formed in the shell of the bag having lower parts which are folded into the plane of the container bottom. In such prior art pleated large-size bags, the pleats are open, whereby the lower side of the pleat is free while the upper side of the pleat becomes taut when stress is applied on the bag. The peak stress is particularly directed on the so-called apex of the pleat, which is constituted by the inside apex point of the large-size bag. Prior art containers of this type have the drawback that the same are frequently ruptured due to the stress conditions arising at the pleat apex, the rupture usually initiating at the pleat apex.

In Finnish Pat. No. 61,174, a so-called pleated large size bag is disclosed, in which the free lower margin of the tubular blank is closed by a bottom seam which is located substantially in the central region of the bottom and the upper plane of each pleat is affixed to the lower plane thereof, by a connecting seam. Such a connecting seam will result in an increased strength of the container bottom by shifting the stresses from the central region of the bottom to the marginal areas thereof. Generally, the opposite planes of the pleat are affixed to each other by a connecting seam of this kind, so that the seam affixes the upper plane of the pleat to the margin of the lower plane of the pleat.

Although relatively high strength of the container bottom is achieved with the flexible container disclosed in Finnish Pat. No. 61,174, this prior art design is also susceptible to failure or rupture always starting at the apex of the pleat and proceeding from the apex point to the outlying bottom area, weakening the bottom of the container which ultimately fails along the bottom seam

SUMMARY OF THE INVENTION

Accordingly, one object of the present invention is to provide new and improved flexible containers for transporting and storing bulk goods.

Another object of the present invention is to provide a new and improved so-called pleated flexible container having a bottom structure which is also sufficiently strong so as to reliably withstand, with respect to the apex point of the pleat, all stresses which may be imposed on the container bottom in actual use.

Briefly, in accordance with the present invention, these and other objects are attained by providing a flexible container constructed of a tubular blank having a free lower margin which is closed by a bottom seam which is located substantially in the central region of the bottom. Pleats are formed in the container shell having lower parts which are folded so as to be coplanar with the container bottom. The upper plane of each pleat is folded down into the plane of the container bottom and affixed to the lower plane of the pleat by a connecting seam. On each side of the bottom seam, there is at least one supporting seam substantially parallel to the bottom seam at a distance therefrom less than $\frac{1}{2}$ of the half-length of the connecting seam.

The distance of the supporting seam from the bottom seam may be from $\frac{1}{3}$ to $\frac{1}{4}$ the half-length of the connecting seam.

The pleats formed in the shell of the flexible container of the present invention are utilized in the manner disclosed in Finnish Pat. No. 61,174 in order to obtain a bottom structure having high strength by closing the pleats by sewing or otherwise affixing the upper side or plane of the pleat to the lower side or plane of the pleats. Susceptibility of the apex of the pleat to failure or rupture is prevented with the aid of a supporting seam on each side of the bottom seam, whereby the strength of the container bottom is increased by up to about 25%.

Furthermore, a flexible container according to the present invention is considerably easier to manufacture than the flexible containers of the first and second type described above. More particularly, fewer working steps are required in the construction of the flexible container of the present invention, since the cutting and affixing operations of the bottom strips necessary in the prior art structures are totally eliminated. Furthermore, the flexible containers of the present invention are eminently suitable for manufacture in an automated manner.

DESCRIPTION OF THE DRAWINGS

A more complete appreciation of the present invnetion and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
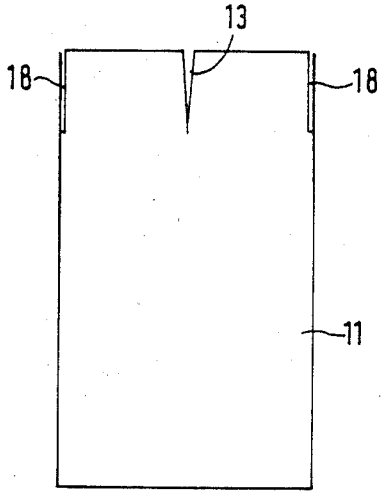
FIG. 1 is a front elevational view of a tubular blank for use in the construction of a container according to the present invention.

Referring now to the drawings wherein like reference characters designate identical or corresponding parts throughout the several views, a flexible container 10 (FIG. 3) is constructed from a tubular blank 11 which is open both at its upper and its lower ends. A cut 13 is formed at the central region of the upper end of the blank 11 for a filling aperture. Moreover, cuts 18 are also provided at the upper end of blank 11 which define strip-like portions 14*a*, 14*b*, 15*a* and 15*b*. The free lower margin of the tubular blank 11 is designated 19 in FIG. 2.

Figure 3:
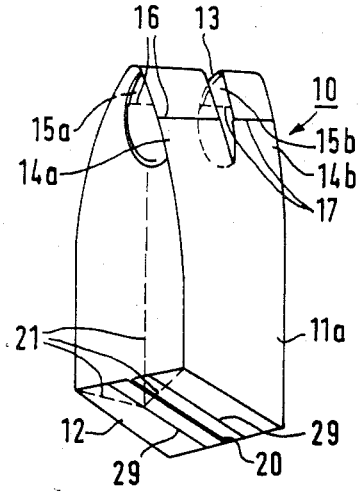
FIG. 3 is a perspective view of a flexible container according to the present invention constructed from the tubular blank illustrated in FIGS. 1 and 2.
Figure 2:
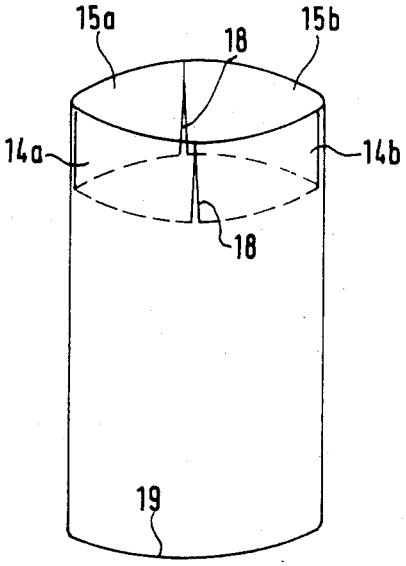
FIG. 2 is a perspective view of the blank illustrated in FIG. 1.

As seen in FIG. 3, a flexible container 10 is constructed from the blank 11 illustrated in FIGS. 1 and 2 and includes a shell 11*a*, a bottom 12, a substantially central filling aperture 13 and lifting loops 14*a*, 15*a* and 14*b*, 15*b*. The container bottom 12 is closed by a connecting seam 20 which is known per se in the art, such seam closing the open free lower margin 19 of blank 11. The blank is formed so that the connecting seam 20 comes to lie substantially in the central region of the bottom 12. As seen in FIG. 3, the flexible container 10 is a so-called pleated container, i.e. two mutually opposed pleats (only one shown) are formed in the shell 11*a*. The pleat is formed as indicated by the dash lines 21, i.e., the lower part of the pleat 21 has been folded so as to be coplanar with the bottom 12 of the container 10.

The lifting loops 14*a*, 15*a* and 14*b*, 15*b* respectively, are advantageously formed in a manner disclosed in Finnish Pat. No. 57,381 as follows. The strip-like portions 14*a* and 15*a* are folded to overlap and the substantially lower margin of the strip-like portion 14*a* is connected with the substantially upper margin of the strip-like portion 15*a* by a connecting seam 16. The strip-like portions 14*b* and 15*b* are thereafter folded to overlap and the substantially lower margin of the strip-like portion 15*b* is joined to the substantially upper margin of the strip-like portion 14*b* by the connecting seam 17. The connecting seams 16 and 17 are then located on the lifting loops 14*a*, 15*a* and 14*b*, 15*b* respectively, on opposite sides thereof. Of course, it is possible to join the strip-like portions 14*b* and 15*b* so that the substantially lower margin of the strip-like portion 14*b* is joined by the connecting seam 17 to the substantially upper margin of the strip-like portion 15*b*. The connecting seams 16 and 17 will then be located on the same side of the lifting loops.

If desired, it is also possible to join the substantially upper margin of the strip-like portion 14*a* to the substantially lower margin of the strip-like portion 15*a* by a second connecting seam 16 while similarly joining the strip-like portions 14*b* and 15*b* in a like manner. In this case, both lifting loops 14*a*, 15*a*, and 14*b*, 15*b* will have two connecting seams 16 and 17 respectively, located on opposite sides and which lie at a substantial distance from the central region of the lifting loops.

Figure 4:
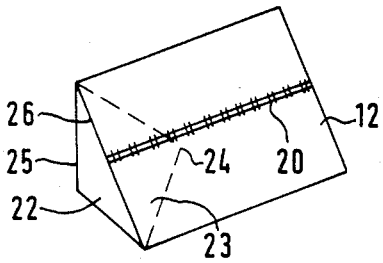
FIG. 4 illustrates the bottom of the flexible container of FIG. 3 viewed obliquely from the underside thereof prior to affixing the opposing planes of the illustrated pleat to each other.

Referring to FIG. 4, the mutually opposed planes of the pleat 21 are indicated by reference numerals 22 and 23 and the apex point of the pleat 21 is designated 24. It is understood that the plane 22 constitutes the upper plane of pleat 21 and correspondingly the plane 23 constitutes the lower plane of the pleat 21. As can be seen in FIG. 4, the margins 25 and 26 of the pleat 21 are separated so that the pleat 21 in this figure constitutes an open pleat.

If the container 10 provided with a bottom 12 as shown in FIG. 4 is stressed, i.e., when the container 10 having a bottom of the type illustrated in FIG. 4 is filled with bulk goods and is lifted, the upper plane 22 of the pleat will be subjected to tension and made taut while the lower plane 23 of the pleat remains free. The peak stress will act particularly at the apex 24 of the pleat 21 which may be characterized as the so-called inner apex point of the container bottom 12. When subjected to loads normally encountered in practice, the bottom 12 of the container 10 having a bottom as illustrated in FIG. 4 will often rupture, the rupture generally being initiated at the apex point 24 of the pleat 21.

Figure 5:
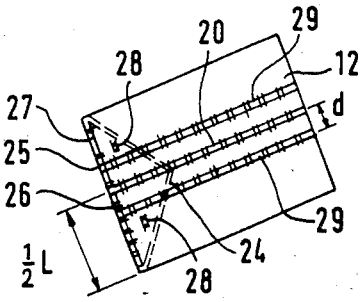
FIG. 5 is a view similar to FIG. 4 illustrating the bottom of the flexible container after the opposing planes of the pleats have been affixed to each other and the supporting seams have been sewn or applied.

The strength of the container bottom 12 is considerably enhanced by affixing the opposed planes 22 and 23 of the pleat to each other. Thus, by utilizing the pleats 21 already existing in the container 10, significant increases in the strength of the container bottom can be achieved. Referring to FIG. 5, the upper plane 22 of pleat 21 is advantageously affixed to the lower plane 23 thereof by affixing the margin 25 of the upper plane 22 to the margin 26 of the lower plane 23 of the pleat such as by sewing or the like. As illustrated in FIG. 5, a connecting seam of this type is designated 27.

According to the present invention, the strength of the container bottom is improved, as illustrated in FIG. 5, by providing at least one supporting seam 29 on each side of the bottom seam 20, paralleling the bottom seam 20. The distance d of each supporting seam 29 from the bottom seam 20, is such that the supporting seams 29 effectively prevent the peak stress from concentrating at the apex 24 of the pleat 21. This distance d is advantageously on the order of about $\frac{1}{3}$ to about $\frac{1}{4}$ the half-length L/2 of the connecting seam 27.

Naturally, this distance d may also be slightly smaller than this range, with the respective supporting seams 29 located as close to the bottom seam 20 as practical sewing conditions permit. If the distance d of the respective supporting seams 29 from the seam 20 is considerably larger, i.e. more than $\frac{1}{2}$ of the half-length L/2 of the connecting seam 27, then the supporting seams will no longer have the same preventative effect on the peak stress, and rupture may therefore possibly start at the apex 24 of the pleat 21. Preferably, the supporting seams 29 are substantially equidistant from the bottom seam 20.

The strength of the bottom 12 of the flexible container 10 of the present invention may be even further enhanced by affixing the opposed planes 22 and 23 of the pleat 21 to each other by one or several additional connecting seams 28. As seen in FIG. 5, two such additional connecting seams 28 are shown which are located substantially in the central region of the pleat 21. Use of these additional connecting seams 28 usually is not necessary because the supporting seams 29 prevent the rupture from starting at the apex 24 of the pleat 21, which is the weakest point of the bottom 12.

It is understood that the construction of the upper part of the container 10 forms no part of the present invention. Thus, a particularly advantageous lifting loop design is shown in the embodiment illustrated in FIGS. 1–3, such design being disclosed in Finnish Pat. No. 573,381. The structure of the container bottom 12 according to the present invention is equally applicable for use on open bags or on large-size bags provided with other types of lifting loops. It should also be noted that the invention is no way limited to the manner in which the pleat 21 is formed. For example, the pleats 21 may also be formed after sewing the bottom seam 20 of the container 10, by forming such pleats in the corners of the bottom seam 20.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A flexible container for transporting and storing bulk goods, said container being constructed from a tubular blank having a free lower margin and formed so as to include a shell, a bottom and a filling aperture, said container being liftable by its upper end, said free lower margin of the tubular blank being closed by a bottom seam located substantially in the central region of said container bottom, and pleats being formed in said shell, each pleat having a lower part folded in a manner so as to be coplanar with said container bottom and including an upper plane and a lower plane, said upper plane of each pleat being folded down into the plane of said container bottom and affixed to said lower plane of said pleat by a connecting seam, at least one supporting seam provided on either side of said bottom seam, said supporting seams being substantially parallel to said bottom seam, and each supporting seam being disposed at a distance from said bottom seam less than about one half the half-length of said connecting seam.

2. The combination of claim 1, wherein each supporting seam is disposed at a distance from said bottom seam from about $\frac{1}{3}$ to about $\frac{1}{4}$ the half-length of said connecting seam.

3. The combination of claim 2, wherein said supporting seams are substantially equidistant from said bottom seam.

* * * * *